United States Patent [19]

Imamura et al.

[11] Patent Number: 4,739,710

[45] Date of Patent: Apr. 26, 1988

[54] APPARATUS FOR CONVEYANCE WITH THE AID OF A MAGNETIC LIQUID

[75] Inventors: Yoshinobu Imamura, Nishinomiya; Makato Yamamura, Kawanishi, both of Japan

[73] Assignee: Hitachi Kiden Kogyo Kabushiki Kaisha, Amagasaki, Japan

[21] Appl. No.: 871,223

[22] Filed: Jun. 6, 1986

[51] Int. Cl.[4] ..... B61B 13/04; B61B 13/08; B60L 13/10

[52] U.S. Cl. ..... 104/281; 104/290; 104/139

[58] Field of Search ..... 104/281, 282, 283, 286, 104/287, 290, 291, 292, 134, 154, 139, 140; 198/619, 679; 310/13, 15, 90; 406/88, 89, 86; 209/904

[56] References Cited

U.S. PATENT DOCUMENTS

| | | | |
|---|---|---|---|
| 3,554,670 | 1/1971 | Starck et al. | 198/619 |
| 3,760,245 | 9/1973 | Halvorsen | 104/154 |
| 3,845,720 | 11/1974 | Bohn et al. | 104/283 |
| 4,138,047 | 2/1979 | Sherman | 406/88 |

FOREIGN PATENT DOCUMENTS

| | | | |
|---|---|---|---|
| 1430761 | 4/1976 | United Kingdom | 104/281 |

*Primary Examiner*—David A. Scherbel
*Assistant Examiner*—Scott H. Werny
*Attorney, Agent, or Firm*—Armstrong, Nikaido, Marmelstein & Kubovcik

[57] ABSTRACT

A conveyor apparatus in which magnetic liquid is provided between a transfer track and a transfer object and a permanent magnet is fitted on the bottom of the transfer object to attract the magnetic liquid to move together with the transfer object thereby serving as a lubricant and permits the transfer object to move on the track afloat or buoyed-up by the magnetic liquid. An edge of a magnetic pole is shaped to have a loft angle in contact with the magnetic liquid to produce an upward component during its movement thereby increasing buoyancy and stability of the transfer object. Dust stir-up is precluded by virtue of the use of a magnetic liquid, as opposed to a conventional pressurized air support method.

7 Claims, 4 Drawing Sheets

APPARATUS FOR CONVEYANCE WITH THE AID OF A MAGNETIC LIQUID

FIELD OF THE INVENTION

This invention relates to an apparatus for conveying a transfer object floating on a magnetic liquid.

DESCRIPTION OF THE PRIOR ART

Conventionally, such a conveying apparatus, known as a planar carrier, has part of a linear motor provided on a transfer object and a number of air nozzles are provided below on a table opposite to the carrier for blowing compressed air upward and thereby floating the transfer object and moving it by simultaneous magnetic excitation of a stator part in the linear motor system involved.

However, the known method requires a source of compressed air, which makes the apparatus costly and it can hardly afford strong buoyancy to the transfer object, which limits its use in some applications. Further, the use of compressed air can not completely preclude stir-up of fine dust during operation, which has disposed the known apparatus to be unsuitable for some applications, for instance, in a semiconductor manufacturing process wherein severe dust-free condition is required. These disadvantages have been deterrent to new applications of conventional conveying apparatus based on linear motor propulsion.

SUMMARY OF THE INVENTION

An object of the invention is to provide a conveying apparatus with superior dust protection as compared to conventional conveyors.

Another object of the invention is to provide a conveying apparatus having the advantage of affording buoyancy with simple mechanism, which will accomplish more versatile apparatus with less cost.

Consequently, this inventive apparatus intends to utilze a linear motor system comprised of a carrier in the form of a bottom of a transfer object and a stator provided opposite to and facing the carrier, wherein included are a transfer track made of non-magnetic material being formed in sectional shape of a guide ditch having an opening at the top, a transfer object which will move on the track, a magnetic liquid which intervenes between the track and the bottom of the leg of the transfer object, and a permanent magnet fitted on the bottom of the leg of the same object.

DESCRIPTION OF THE PREFERRED EMBODIMENTS

Figure 1:
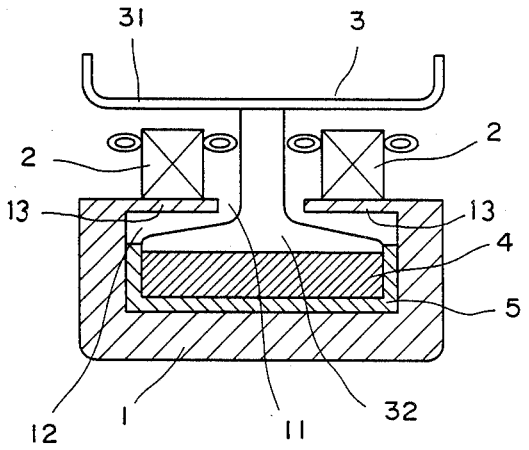
FIG. 1 is a sectional view of the inventive conveying apparatus seen in the direction of transfer or move.

In FIG. 1, 1 is a transfer track made of non-magnetic material which is secured on a substructural pedestal (not shown), and as shown by the sectional view, the transfer track 1 is configured to be a guide ditch having an opening 11 at the top and space 12 inside the ditch. Covers 13, 13 serve to prevent magnetic liquid 5 from flowing out and evaporating, besides forming holding bases for stators 2, which will be noted below.

Stators 2, 2 are for a linear motor, double-lined along the track 1 with a certain interval, which are wound in coil to generate magnetic flux directing to a transfer object 3 lying above. 3 is a transfer object, for instance, trolley or pallet, to carry some articles, which comprises a bottom plate 31 and a leg (as noted later, in some embodiment, leg becomes plural) 32. The bottom 31 will function as a carrier of the linear motor system and accordingly is made of aluminum or copper or other electrically conductive material. The stators 2 are, as shown, disposed side by side in the pairs in moving direction of the transfer object 3. A permanent magnet 4 is fitted on the bottom surface, of the leg 32, and at the front and rear ends of the leg 32 which are seen to the right and left in FIG. 2, a pair of magnetic pole pieces 41, 41 are fitted respectively by bolts 42, 42 so that a hook-up shape in section of the pole 41, as shown in FIG. 3, may be in contact with the magnetic liquid 5 forming a loft angle with respect to the surface of the magnetic liquid 5.

Figure 3:
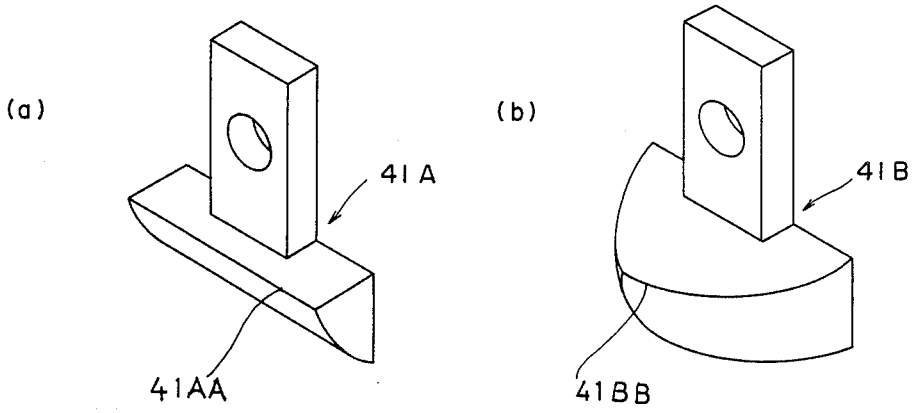
FIGS. 3(*a*) and 3(*b*) are perspective views of two magnetic poles with different shapes.

The pole 41 may take another variant shape as shown in FIG. 3 (a), as numbered 41A forming the hook edge 41AA like a ship-side or as numbered 41B forming the hook edge 41BB like a ship-head in the direction of the track.

Further, intervening space between the permanent magnet 4 and inner surface of the guide ditch 1 is occupied by a magnetic liquid 5, which may be a colloidal solution comprising magnetic micro-particles, for instance, ferrite particles, coated with long chain unsaturated aliphatic acid and dispersed with the use of a surfactant, known in the art and which deserves in this invention a gathering of elements having permanent magnetic momentum, hence forming a paramagnetic material. Consequently, the liquid 5 is magnetically exerted by magnetism generated from the permanent magnet 4 provided on the bottom surface of the leg 32 and thereby the transfer object 3 is floated or buoyed-up and supported on enabled to move afloat with the liquid 5 under propulsive force rendered by the linear motor comprised of the stators 2, 2 and the transfer object plate 3.

Figure 2:
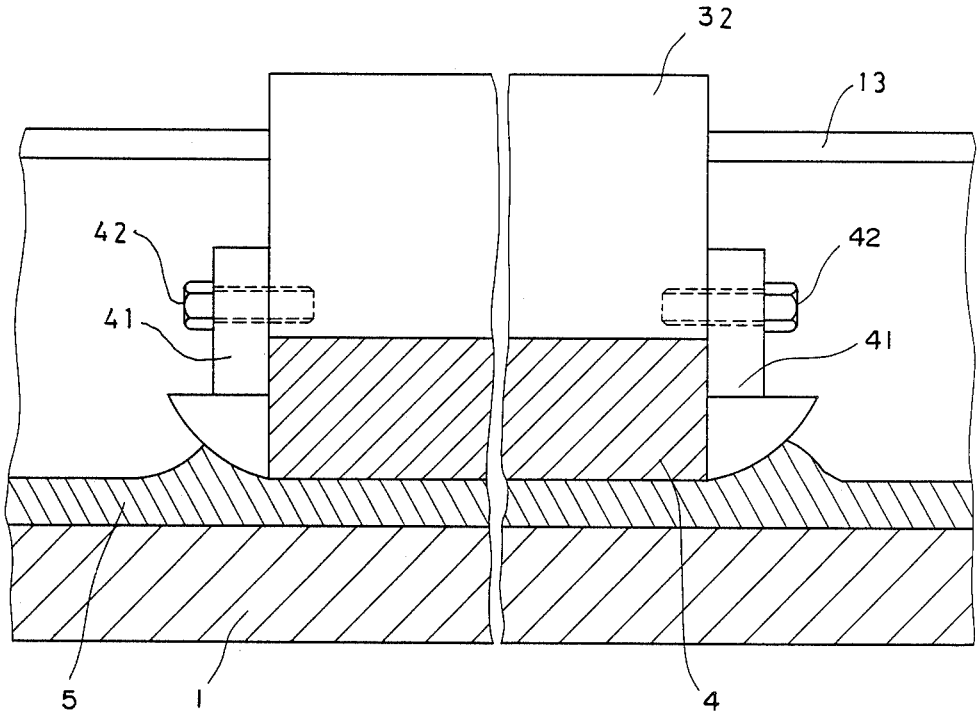
FIG. 2 is a partly broken, sectional side elevation view of the apparatus of FIG. 1.
Figure 4:
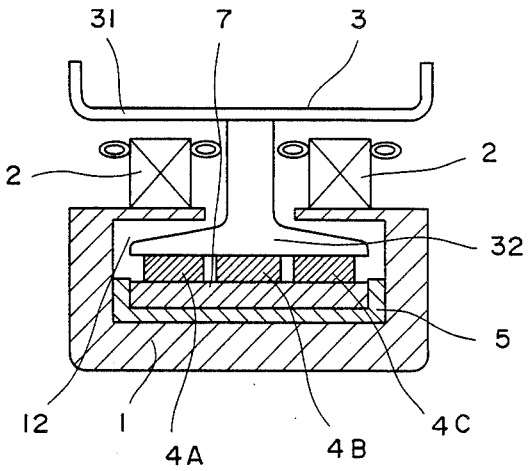
FIG. 4 is a sectional view of another embodiment of the inventive conveying apparatus seen in direction of transfer.

FIG. 4 shows another inventive embodiment wherein the permanent magnet 4 is not one block, but is divided to a plurality of pieces (three pieces in FIG. 4) and on the bottom surfaces of these divided magnets, the pole 7 is fitted with dimension of flat, one-piece panel coextensive with bottom surface of the leg 32 and it is further integrally connected at rear and front ends with hooked pole pieces like the ones shown in FIG. 2 or in FIG. 3 (not shown in FIG. 4).

Figure 5:
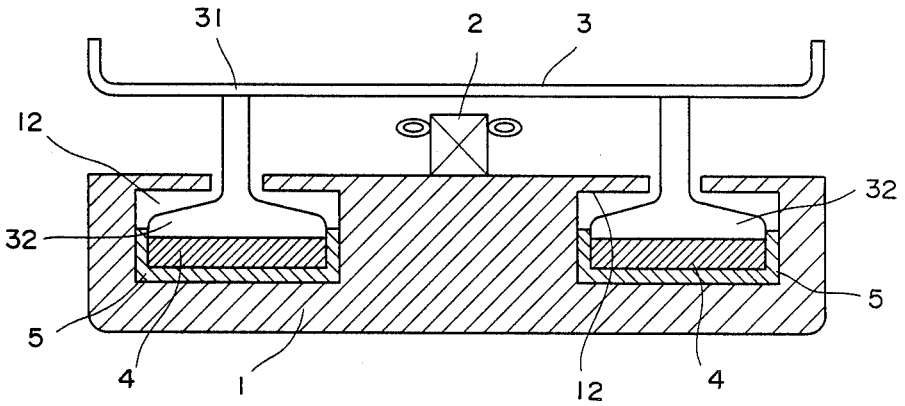
FIG. 5 is a sectional view of still another embodiment of the, inventive conveying apparatus seen in direction of transfer.

A further variant embodiment is illustrated in FIG. 5, wherein the transfer object 3 is provided, sectionally viewed, with a pair of legs 32, 32 at its substructure forming roughly a shape of tortoise in section to which correspondingly the transfer track 1 has two recessed spaces or guide ditches to accommodate the legs 32, 32 and other elements. Therewith, one stator 2 is provided at the center on the track section, but as shown in FIG. 4, two pairs of stators may be alternately provided in place, one pair at each leg 32. And herein poles like in FIG. 2 are assumed to be fitted at front and rear ends with the permanent magnet 4.

Making reference to the magnetic mechanism involved in the invention, the magnetic liquid 5 is regarded as a gathering of elements having a permanent magnetic momentum, in particular, paramagnetism and, by exertion of magnetism generated from the pemanent magnet 4 placed on the bottom surface of the leg 32, magnetization of the liquid 5 takes place and consequently, during moves of the transfer object 3 by propulsive force from the linear motor drive, the liquid 5 moves together with the magnet 4 exhibiting a cushioning or lubrication function which can not be attained by conventional gas blow method, and wherein movement of the liquid 5 is so smooth and without shock by maintaining the object 3 afloat thereon. Further, the pole edges are shaped upward at the contact point with the liquid 5 so that the floating object 3 receives reaction leading to be upward buoyance and thereby increased buoyancy is attained and stable transfer is always accomplished.

Different from the conventional air blow method, this invention precludes dust stir-up. In the case that the pole of type shown in FIG. 3(*b*) is employed, the edge like ship-head will attenuate resistance to the liquid 5, hence superior performance will be obtained.

We claim:

1. Apparatus for conveyance including a linear motor comprised of a carrier in the form of a bottom of a transfer object and a stator provided to oppose the carrier, wherein further included are a transfer track made of nonmagnetic material forming in section a guide ditch having an open top, a transfer object adapted to move along the track, a magnetic liquid which intervenes between the track and a depending leg of the transfer object, a plurality of permanent magnets fitted on the bottom surface of the leg of the transfer object, and magnetic pole pieces provided on the bottom surface of said permanent magnets.

2. Apparatus for conveyance including a linear motor comprised of a carrier in the form of a bottom of a transfer object and a stator provided to oppose the carrier, wherein further included are a transfer track made of nonmagnetic material forming in section a guide ditch having an open top, a transfer object adapted to move along the track, a magnetic liquid which intervenes between the track and a depending leg of the transfer object, a plurality of permanent magnets fitted on the bottom surface of the leg of the transfer object, and magnetic pole pieces provided on the bottom surface of said permanent magnets and having the shape of a hook at the front and rear ends of the transfer object.

3. A conveying apparatus comprising a transfer track made of non-magnetic material forming in section a guide ditch open at the top, a magnetic liquid internal of said transfer track, a stator forming part of a linear motor mounted on said transfer track, a transfer object adapted for movement along said transfer track, said transfer object having a portion located above said transfer track and a leg depending from said portion into said guide ditch, said portion of said transfer object being formed of an electrically conductive material and cooperating with said stator as the movable part of said linear motor and a permanent magnet fitted on the bottom of said depending leg of said transfer object to attract and maintain said magnetic liquid between said permanent magnet and said transfer track.

4. The conveying apparatus defined by claim 3 wherein magnetic pole pieces are respectively fitted at the front and rear ends of said permanent magnet.

5. The conveying apparatus defined by claim 4 wherein said magnetic pole pieces have an upwardly covered surface where they contact said magnetic liquid.

6. The conveying apparatus defined by claim 3 wherein said permanent magnet is comprised of a plurality of separate magnet pieces and a single, metal plate of uniform thickness and coextensive with the bottom surface of said depending leg is fitted on the bottom surface of said separate magnet pieces.

7. The conveying apparatus defined by claim 6 wherein hooked magnetic pole pieces are respectively fitted at the front and rear ends of said transfer object.

* * * * *